United States Patent [19]

Pope

[11] Patent Number: 4,976,296

[45] Date of Patent: Dec. 11, 1990

[54] FILLING MACHINES

[75] Inventor: Peter E. Pope, Frinton-On-Sea, United Kingdom

[73] Assignee: Portals Engineering Limited, Essex, United Kingdom

[21] Appl. No.: 383,583

[22] Filed: Jul. 24, 1989

[30] Foreign Application Priority Data

Jul. 25, 1988 [GB] United Kingdom ..... 8817708

[51] Int. Cl.[5] ..... B65B 1/16; B65B 31/04

[52] U.S. Cl. ..... 141/46; 141/59; 141/67; 366/178

[58] Field of Search ..... 141/46, 51, 59, 61, 141/4, 5, 8, 10–12, 67, 71, 73, 80, 81, 65, 7, 90, 128, 56; 366/178, 139

[56] References Cited

U.S. PATENT DOCUMENTS

| | | | |
|---|---|---|---|
| 2,587,089 | 2/1952 | Balla, Jr. | 141/59 X |
| 3,265,098 | 8/1966 | O'Neal et al. | 141/5 |
| 3,506,111 | 4/1970 | Eppenberger | 406/24 |
| 3,586,069 | 6/1971 | Vest et al. | 141/102 |
| 3,693,672 | 9/1972 | Hiland | 141/7 |
| 3,716,082 | 2/1973 | Green | 141/68 |
| 3,792,724 | 2/1974 | Stanelle | 141/93 X |
| 3,797,890 | 3/1974 | Walters | 406/33 |
| 3,858,628 | 1/1975 | Bendle | 141/46 |
| 3,884,401 | 5/1975 | Winkler | 222/544 |
| 4,182,591 | 1/1980 | Stanelle | 141/93 X |
| 4,212,331 | 7/1980 | Benatar | 141/67 |
| 4,219,054 | 8/1980 | Carter et al. | 141/10 |
| 4,313,476 | 2/1982 | Bennett et al. | 141/59 |
| 4,573,504 | 3/1986 | Rosenström | 141/59 |
| 4,614,213 | 9/1986 | Englin | 141/59 |
| 4,688,610 | 8/1989 | Campbell | 141/83 |
| 4,735,241 | 4/1988 | Spiess | 141/68 |

FOREIGN PATENT DOCUMENTS 2158813 11/1985 United Kingdom .

*Primary Examiner*—Henry J. Recla
*Assistant Examiner*—Casey Jacyna
*Attorney, Agent, or Firm*—Beveridge, DeGrandi & Weilacher

[57] ABSTRACT

The disclosure relates to a dispensing unit for a filling machine for filling containers with particulate material comprising a nozzle having an outlet end for delivery of particulate material to a container. The nozzle is encircled by a downwardly facing seal to engage the upper open end of the container. The nozzle has an outer annular cavity terminating in an annular port around the open end of the nozzle in which a relatively high vacuum is drawn to evacuate the container and draw material through the passageway into the container. The nozzle has an inner annular cavity terminating in a porous wall encircling the discharge end of the nozzle in which a relatively low vacuum is drawn to adhere material in the nozzle to the wall of vacuum and terminate flow through the nozzle.

10 Claims, 6 Drawing Sheets

VACUUM SOURCE
VACUUM SOURCE
11
10
12
15
13
16
14
29
25
19
23
24
18
17
28
27
26
22
21
20
13
14
19
21
22
23

FILLING MACHINES

BACKGROUND TO THE INVENTION

1. FIELD OF THE INVENTION

This invention relates to improvements in filling machines and more particularly in filling nozzles/valves provided in machines that are used to fill containers with particulate materials.

2. BACKGROUND PRIOR ART

Dispensing nozzles for machines for filling containers with particulate materials are known in which the nozzle is encircled by a seal to engage the mouth of a container to be filled into which the nozzle projects and vacuum is drawn through an annular port around the open end of the nozzle to evacuate the container and thereby cause particulate material from the nozzle to be discharged into the container to the level of the bottom of the nozzle whereafter the vacuum is terminated and the filled container removed. Difficulties arise in such nozzles in ensuring that no material is discharged by the nozzle prior to placement of the container and drawing of the vacuum.

SUMMARY OF THE INVENTION

This invention provides a dispensing unit for particulate material comprising, a nozzle having an outlet for delivery of particulate material to a container, means to seal an open end of the container around the nozzle for filling from the nozzle, means to evacuate the container to draw material from the nozzle into the container and means to draw vacuum in the nozzle outlet to cause particulate material flowing through the outlet to consolidate and block the outlet between the filling operations.

In one arrangement according to the invention the nozzle may include a annular porous wall located within the outlet of the nozzle and said means to draw vacuum in the nozzle outlet communicates with the outer side of the porous wall to cause material passing through the annular wall to adhere to the wall and block flow through the nozzle.

More specifically the nozzle may comprise a delivery conduit terminating in said annular porous wall at the outlet end thereof and a further conduit encircling and disposed concentrically with respect to the delivery conduit with a gap between the respective conduits to which said means to draw vacuum at the nozzle is connected to cause the particulate material to consolidate within the porous end part of the delivery conduit.

Further, an annular end cap may be provided at said outlet end of the nozzle to seal between the porous end of the delivery conduit and the encircling end of the further conduit.

In any of the above arrangements the further conduit may be encircled by an outer conduit with a gap between the outer and further conduits to which said evacuating means is connected, there being an open annular gap between the further and outer conduits at the outlet end of the nozzle through which the interior of a container to be filled is evacuated to draw material from the delivery conduit of the nozzle into the container until the level of material in the container reaches the delivery end of the nozzle.

Also in any of the above arrangements the nozzle may be mounted within a downwardly open chamber to receive a container to be filled, the nozzle projecting downwardly into the chamber and the chamber having an annular seal encircling the nozzle to seal with the upper open end of the container to be filled.

In a further construction according to the invention the means to evacuate the container may be capable of drawing a relatively high filling vacuum in relation to the means to draw vacuum in the outlet nozzle and control means may be provided for the means to evacuate the chamber to establish the vacuum when a container is in position to be filled to overcome the effect of the vacuum at the outlet nozzle consolidating the material in the nozzle to fill the container and, to be released when the filling operation is completed to allow the vacuum applied to the outlet nozzle to re-consolidate the material in the nozzle when the filled container is removed.

In a further arrangement control means may be provided for the means to draw vacuum within the outlet of the nozzle to release the vacuum during the filling of the container and to re-establish the vacuum when the container is filled to re-consolidate the material in the nozzle outlet and thereby prevent release of material when a filled container is removed.

In any of the above arrangements a plurality of said nozzles is provided to fill, simultaneously or sequentially, a corresponding plurality of containers.

DESCRIPTION OF THE PREFERRED EMBODIMENTS

Figures 1, 1A:
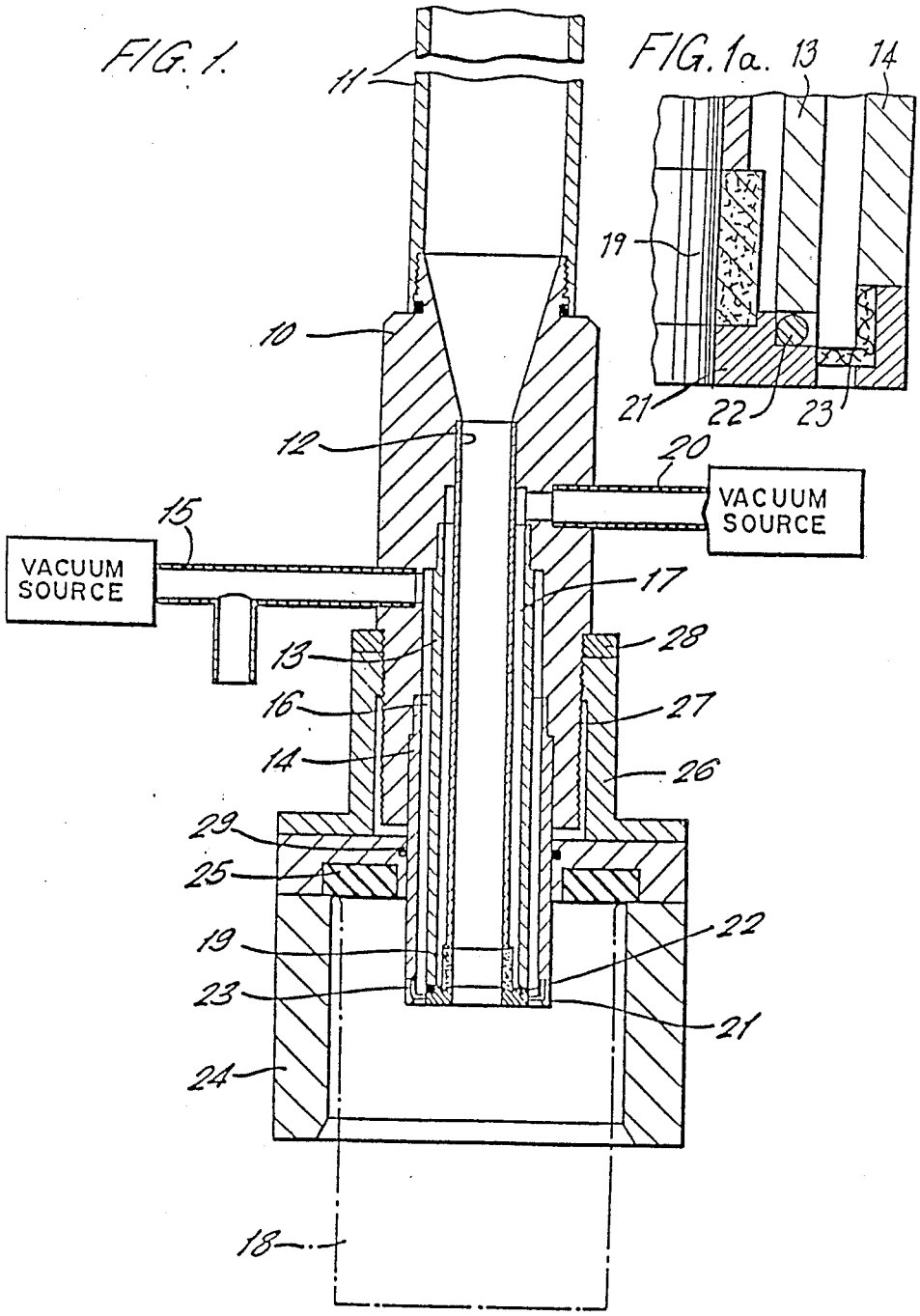
FIG. 1 is a sectional view through a filling nozzle for particulate material in a filling machine in accordance with the invention.
FIG. 1*a* is an enlarged fragmentary view of part of the lower end of the filling nozzle.

The drawing illustrates a complete nozzle assembly suitable for filling containers with a particulate material, for example, talcum powder, salt or other flowable products. The assembly comprises a main body 10, provided at its upper end with a product entry tube 11, and a series of concentric tubes 12, 13 and 14. The outer tube 14 is fixed to the body 10 and extends downwards to suit the type and size of container to be filled and through which a relatively high filling vacuum is applied through conduit 15, connected to suitable vacuum control valves to control the application of vacuum and the level of vacuum applied as described later.

The intermediate tube 13 forms an inner wall for the filling vacuum chamber 16 and an outer wall for a plenum chamber 17 to which a relatively low level vacuum is communicated through conduit 20. An inner delivery tube 12 is provided which forms the inner wall of the plenum chamber 17 and through which product flows into the container shown in chain outline at 18.

At the lower end of tube 12 a porous section 19 is provided to allow the control vacuum in the plenum chamber 17 to be drawn through the wall of the porous section from the inner product contact surface of tube 12. A lower cap 21 is provided to retain the porous section 19 in close proximity to the inner tube 12 and also carries a seal 22 which seals and isolates the control vacuum in plenum chamber 17 from the filling vacuum in chamber 16. The lower annulus or end of chamber 16 is provided with a wire mesh gauze 23 or some similar material which allows vacuum flow but restricts product particle flow as much as is practicable from entering the vacuum system.

A container 18, to be filled with product, is introduced into a guide sleeve 24 and seals against a resilient sealing member 25. The height to which product is filled in the container may be adjusted by turning adjusting ring 26 on thread 27 either upwardly or downwardly to change the relationship between the nozzle lower cap 21 and the distance to the container seal 25. This distance approximates to the level of the product below the top of the container when filled. When this adjustment is completed the body 10 and adjusting ring 26 are locked in position by locking ring 28 to fix their relative position. An "O" ring seal 29 is provided between adjusting ring 26 and outer tube 14 to prevent loss of vacuum when filling.

With some forms of particulate product, in particular those types which have free-flowing properties, the feeding of product down the tubes 11 and 12 would result in the material passing through the valve and out of the lower cap 21 without any control. By application of very low vacuum pressures in the plenum chamber 17 and through the pores of the porous section 19, it is possible to attract particulate material to attach itself to the inner wall of section 19 causing positive bridging of the product and arresting of the product flow.

In one application of this invention the low control vacuum is maintained to the porous section 19 at all times and the product is held within the delivery tube 12 when a container is not present on the nozzle. When a container is applied to the nozzle for filling and it is sealed against the component 25. A relatively high vacuum - called the filling vacuum - is then applied through connection 15 which evacuates the container through gauze 23 and cap 21 causing the higher filling vacuum to overcome the lower control vacuum in the area of section 19. This allows product to flow down the central tube 12 filling the container to approximately the level of the underside of the cap 21 when a state of equilibrium occurs. If the filling vacuum is now turned off and broken, due to atmosphere, or by the introduction of, say, an inert gas, the product will be prevented from further discharging from the central tube by the pressure of the control vacuum.

In another embodiment of the invention, means are provided for varying the control vacuum to enable this to be switched off during the filling cycle and re-introduced before the filling vacuum is broken and the container removed to prevent flow or a "dribble" of the material from the lower, delivery end of tube 3.

A plurality of such nozzle assemblies may be provided to supply, from a source of particulate material, a corresponding plurality of containers in sequence (or possibly simultaneously). The nozzles may be arranged "in line" or may be mounted on a rotary head to feed containers moving in a corresponding path.

Figure 2:
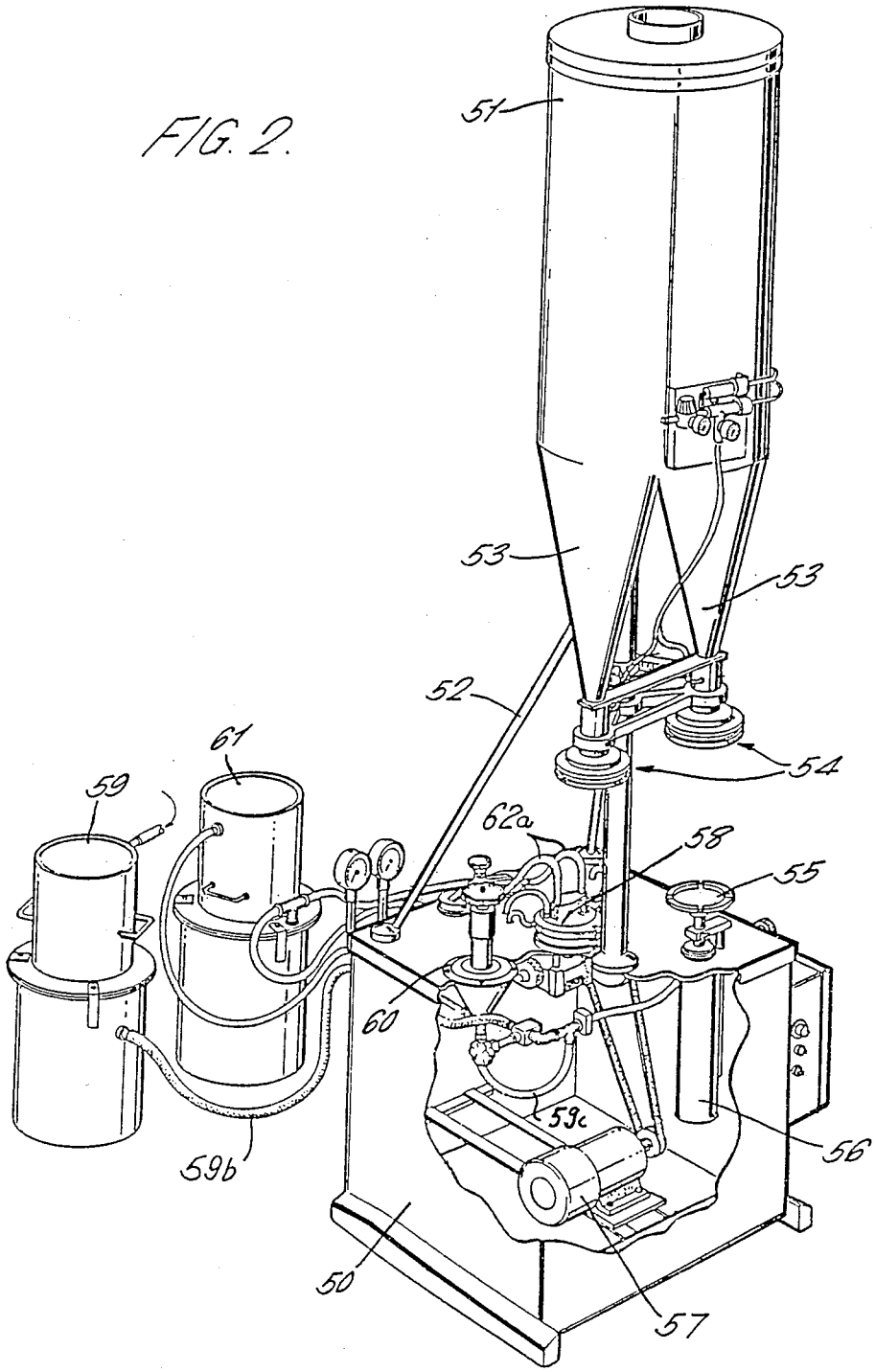
FIG. 2 is a perspective view of a filling machine embodying filling nozzles in accordance with the invention.
Figure 3:
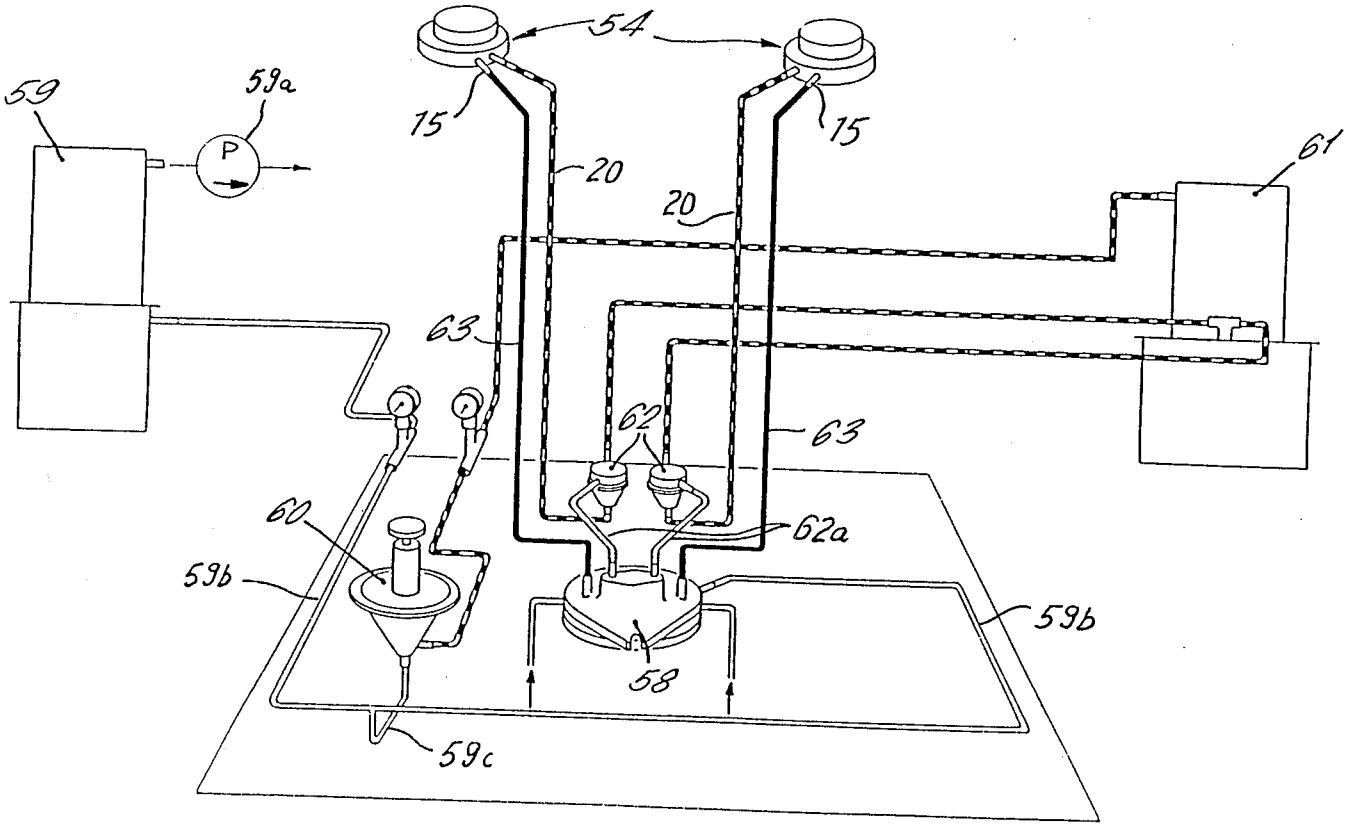
FIG. 3 is a circuit diagram of a part of a pneumatic circuit for the filling machine of FIG. 2.
Figure 4:
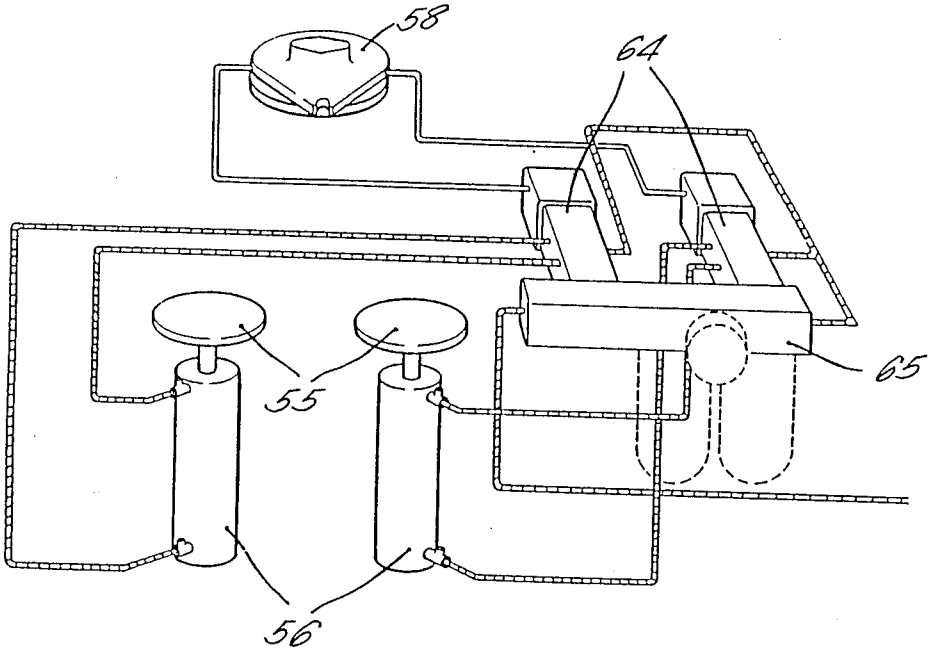
FIG. 4 is a circuit diagram for a vacuum controlled pneumatic circuit for operating container lifting tubes in the filling machine.

One such arrangement is shown in FIGS. 2 to 4 of the drawings to which reference will now be made. FIG. 2 shows a filling machine comprising a hollow cubic form base 50 on which a hopper 51 for particulate material is mounted by means of the tripod structure 52. The hopper has twin downwardly extending outlet ducts 53 which taper towards their lower ends and filling nozzles indicated at 54 of a form described and illustrated with reference to FIG. 1 above are mounted at the lower ends of the outlets. Containers to be filled are supported on a pair of tables 55 raised and lowered by means of pneumatic rams 56 mounted within the housing 50.

The housing 50 also contains an electric motor 57 for driving a rotary valve 58 mounted on the housing for controlling the sequence of operation of the various elements of the machine.

A vacuum pump **59*a* is connected to a high vacuum receiver/filter 59 having an outlet conduit 59*b* connected to the valve 58 with a branch connection 59*c* to a vacuum reducing valve 60 mounted in the housing. The vacuum reducing valve is connected to a low vacuum receiver/filter 61 disposed outside the housing which in turn has parallel connections through relay valves 62 as shown in FIG. 3 of the drawings and thence to the conduits 20 of the filling released, the lifting table 55 will descend to free nozzles 54 to apply said low control vacuum for arresting product flow as aforesaid. The valve 58 has further connections 63,15** to the filling nozzles to supply said relatively high filling vacuum and also to break the vacuum applied thereto.

The control side of each relay valve 62 is connected by connections **62*a* to the rotary valve 58. At the appropriate time following completion of a filling operation, the rotary valve 58 will shut off the high filling vacuum and apply release air or inert gas to the nozzles to break the vacuum hold. Relay valves 62 are opened to supply the low flow arresting vacuum to the nozzle 54 via connections 20. As soon as the high vacuum has been released, the lifting table 55 will decend to free released, the lifting table 55** will descend to free the containers from the filling nozzles where they can then be removed and replaced with empty containers and the filling cycle repeated.

The rotary valve 58 has further connections to the control sides of a pair of relay valves 64 for connecting compressed air supplied through a manifold 65 connected to an air compressor or factory mains compressed air supply. Valves 64 connect to either side of the vertically acting pneumatic cylinders 56 for raising and lowering the container support tables 55.

By varying the speed of rotation of the valve 58, the filling output can be increased or decreased according to requirements.

Figure 5:
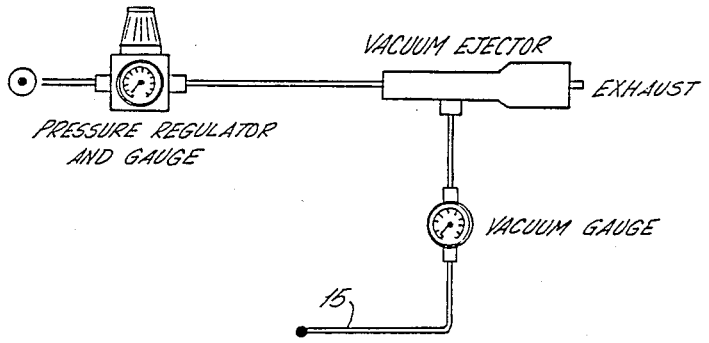
FIG. 5 illustrates a modification to the circuit for a filling machine having a single filling nozzle.
Figure 6:
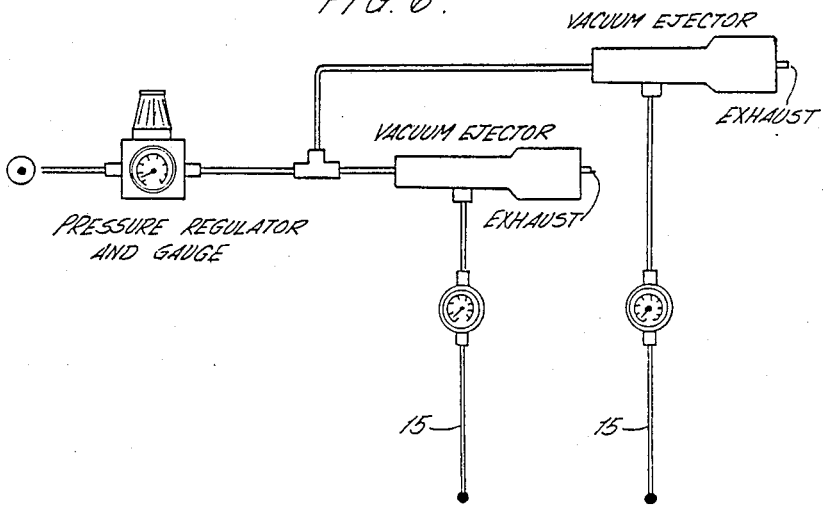
FIG. 6 is a modification of the circuit for a filling machine, having twin filling nozzles.
Figure 7:
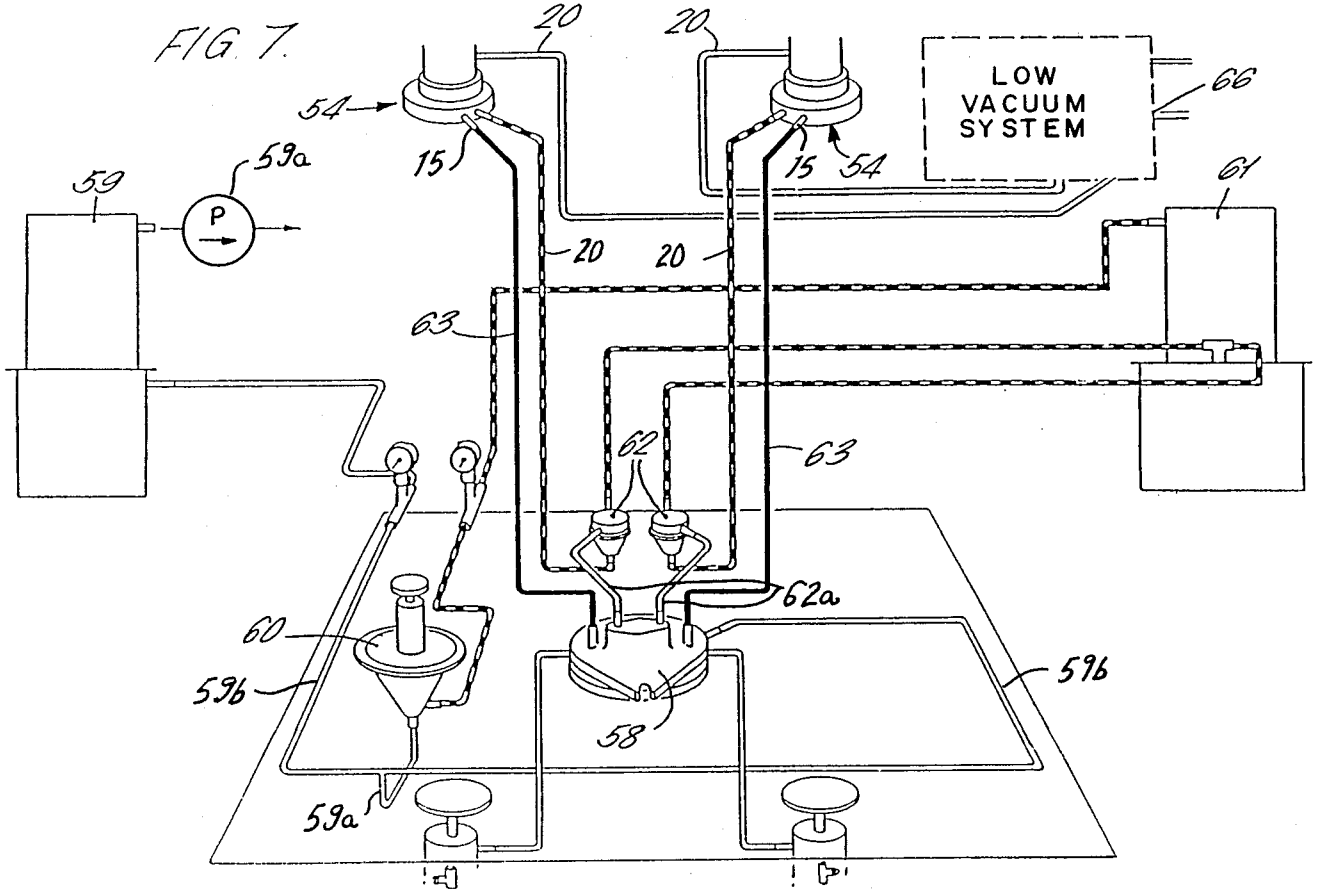
FIG. 7 illustrates the application of the modification to the complete circuit of FIG. 3.

FIG. 7 of the drawings illustrates an additional low vacuum system 66 which is connected direct to the nozzle assemblies 54. The low control vacuum is maintained to the porous section 19 of the filling nozzle at all times and the product is held within the delivery tube 12 when the container is not present on the nozzle as described earlier. In the case of a very large rotary multihead filling machine, it is intended that the central rotary valve would be used to introduce the very low vacuum to the nozzles and alternate this at an arc of fill by either shutting off this low vacuum or shutting off the vacuum and introducing very low air pressure to the porous insert. FIGS. 5 and 6 illustrate diagrammatically the application of the low vacuum system to a single and plural filling nozzle machine.

In a still further arrangement, the control vacuum may be switched off at the commencement of a filling operation and a low pressure air supply coupled through conduit 20 to the plenum chamber 17. The resulting low pressure air flow through the porous section 19 facilitates flow of the particulate material through the nozzle because of the reduced surface friction at the surface of section 19 provided by the air flow. This is particularly beneficial with certain types of materials which tend to consolidate in the nozzle. Towards the end of the filling operation the air pressure supply is disconnected and the control vacuum re-established to terminate flow when the required volume of material has been discharged by the nozzle.

I claim:

1. A dispensing unit for particulate material comprising, a nozzle having an outlet for delivery of particulate material to a container, means to seal an open end of the container around the nozzle for filling container, first vacuum applying means for evacuating the container applied to the nozzle, said first vacuum applying means having an inlet means located at the lower end of the nozzle adjacent to the nozzle outlet, the inlet means including means to prevent the flow of particulate material through the inlet means when the level of particulate material reaches the level of the inlet means to block the inlet means, a porous member located in the nozzle, said porous member and said inlet means being at substantially the same elevation, second vacuum applying means for drawing at said porous member a vacuum which is less than the vacuum at the inlet means of said first vacuum applying means, said second vacuum applying means being operable with said porous member to consolidate and prevent release of material from the outlet from the flow of material through the outlet ceases from the container is filled to the elevation of the nozzle outlet so that the container can be removed from the dispensing unit without risk of further discharge from the outlet nozzle.

2. A dispensing unit as claimed in claim 1, wherein the nozzle includes a annular porous wall located within the outlet of the nozzle and said means to draw vacuum in the nozzle outlet communicates with the outer side of the porous wall to cause material passing through the annular wall to adhere three to and block flow through the nozzle.

3. A dispensing unit as claimed in claim 2, wherein the nozzle comprises a deliver conduit terminating in said annular porous wall at the outlet end thereof and a further conduit encircling and disposed concentrically with respect to the delivery conduit with a gap between the respective conduits to which said means to draw vacuum at the nozzle is connected to cause the particulate material to consolidate within the porous end part of the delivery conduit.

4. A dispensing unit as claimed in claim 3, wherein an annular end cap is provided at said outlet end of the nozzle to seal between the porous end of the delivery conduit and the encircling end of the further conduit.

5. A dispensing unit as claimed in claim 3, wherein the further conduit is encircled by an outer conduit with a gap between the outer and further conduits to which said evacuating means is connected, there being an open annular gap between the further and outer conduits at the outlet end of the nozzle through which the interior of a container to be filled is evacuated to draw material from the delivery conduit of the nozzle into the container until the level of material in the container reaches the delivery end of the nozzle.

6. A dispensing unit as claimed in claim 1, wherein the nozzle is mounted within a downwardly open chamber to receive a container to be filled, the nozzle projecting downwardly into the chamber and the chamber having an annular seal encircling the nozzle to seal with the upper open end of the container to be filled.

7. A dispensing unit as claimed in claim 1, wherein the means to evacuate the container is capable of drawing a relatively high vacuum in relation to the means to draw vacuum in the outlet nozzle and control means are provided for the means to evacuate the chamber to establish the vacuum when a container is in position to be filled to overcome the effect of the vacuum at the outlet nozzle consolidating the material in the nozzle to fill the container and, to be released when the filling operation is completed to allow the vacuum applied to the outlet nozzle to re-consolidate the material in the nozzle when the filled container is removed.

8. A dispensing unit as claimed in claim 1, wherein control means are provided for the means to draw vacuum within the outlet of the nozzle to release the vacuum during the filling of the container and to re-establish the vacuum when the container is filled to re-consolidate the material in the nozzle outlet and thereby prevent release of material when a filled container is removed

9. A dispensing unit as claimed in claim 1, wherein a plurality of said nozzles is provided to fill, simultaneously, a corresponding plurality of containers.

10. A dispensing unit according to claim 1 wherein there is a first passage which extends axially in the nozzle to the inlet means of the first vacuum applying means, and a second passage which extends axially in the nozzle and leads to the porous member, said first and second passages both substantially extending to the nozzle outlet.

* * * * *